US006543579B2

(12) United States Patent
Laug

(10) Patent No.: US 6,543,579 B2
(45) Date of Patent: Apr. 8, 2003

(54) LADDER WITH A FLOOR BOARD

(76) Inventor: Horst Laug, Haselünner Strasse 72, D-49808 Lingen (DE)

( * ) Notice: Subject to any disclaimer, the term of this patent is extended or adjusted under 35 U.S.C. 154(b) by 0 days.

(21) Appl. No.: 10/034,916

(22) Filed: Nov. 21, 2001

(65) Prior Publication Data

US 2002/0139612 A1 Oct. 3, 2002

Related U.S. Application Data

(63) Continuation of application No. PCT/DE00/01486, filed on May 4, 2000.

(30) Foreign Application Priority Data

May 22, 1999 (DE) ..... 199 23 765

(51) Int. Cl.[7] ..... E06C 1/30
(52) U.S. Cl. ..... 182/27; 182/209; 182/115
(58) Field of Search ..... 182/27, 225, 153, 182/20, 222, 209, 115

(56) References Cited

U.S. PATENT DOCUMENTS 5,332,062 A * 7/1994 Revere ..... 182/27
5,358,069 A * 10/1994 Krause ..... 182/118
5,626,205 A * 5/1997 Martin ..... 182/153

FOREIGN PATENT DOCUMENTS

DE 197 14 431 A 1 10/1998
DE 298 21 356 U 1 4/1999
FR 2 582 702 12/1986

OTHER PUBLICATIONS

International Search Report for PCT/DE00/01486, issued by the European Patent Office on Aug. 9, 2000.

* cited by examiner

*Primary Examiner*—Alvin C. Chin-Shue
(74) *Attorney, Agent, or Firm*—Laurence A. Greenberg; Werner H. Stemer; Ralph E. Locher

(57) ABSTRACT

A length-adjustable ladder functioning as a telescopic lean-to ladder, a free-standing stepladder, and as a platform is described. The ladder includes stringers, ladder rungs fastened between the stringers, and supports connected to the stringers. The supports can be length-adjusted in a stepless manner. The supports can be swung in and arrested on the outer longitudinal sides of the stringers. A floor board assembly formed of two panel halves corresponding to a length of the ladder and has hinges is disposed on the two panel halves. The two panel halves each have a longitudinal side fastened, in an articulated manner on the ladder rungs by the hinges. Arresting elements are provided. Each of the arresting elements run through one of the two panel halves. The two panel halves are movable into a swung-up panel position wherein the two panel halves are arrested by the arresting elements.

5 Claims, 2 Drawing Sheets

LADDER WITH A FLOOR BOARD

Cross-Reference to Related Application

This application is a continuation of copending International Application No. PCT/DE00/01486, filed May 4, 2000, which designated the United States.

BACKGROUND OF THE INVENTION

Field of the Invention

The invention relates to a ladder with a floor board. The ladder is of a length-adjustable configuration and has supports, which can be swung in and arrested on the outer longitudinal sides an are configured such that they can be length-adjusted in a stepless manner and, by diagonal ties and struts which can be adjusted in a stepless manner, can be pivoted out in all directions and secured.

A configuration of the generic type is known from German Utility Model DE 298 21 356 U1, in which a description is given of stabilizing supports for stepladders and lean-to ladders. The diagonal ties and struts are configured to be fastened in an articulated manner in pairs such that they can be swung in and out in parallel on the longitudinal sides of a stabilizing support and can be arrested. Published, Non-Prosecuted German Patent Application DE 197 14 431 A1 discloses a ladder with widened rungs, which can be tilted about an axis between the supports. This enables the rungs to be in a position, which is identical to that of a conventional ladder, while in a folded-over position, the edges of the rungs touch each other and therefore form a closed surface.

Working platforms or multipurpose boardings are used as small scaffolding systems that are quick to construct.

It is usually the case, at present, to produce working platforms from two set-up stepladders with boards positioned therebetween.

Such configurations require considerable production outlay, and the working platforms produced in makeshift form from individual boards and separate ladders are awkward to manage as a result of the individual parts, which are stored and transported separately and can only be used to a limited extent on steps or stairways.

SUMMARY OF THE INVENTION

It is accordingly an object of the invention to provide a ladder with a floor board which overcomes the above-mentioned disadvantages of the prior art devices of this general type, which can be used both as a conventional ladder and as a working platform.

With the foregoing and other objects in view there is provided, in accordance with the invention, a length-adjustable ladder functioning as a telescopic lean-to ladder, a free-standing stepladder, and as a platform. The ladder includes stringers each having a top end and an outer longitudinal side, ladder rungs fastened between the stringers, and supports connected to the stringers. The supports are configured such that the supports can be length-adjusted in a stepless manner. Diagonal ties and struts adjustable in a stepless manner are connected to the supports such that the supports can be pivoted out in all directions and secured. The supports can be swung in and arrested on the outer longitudinal sides of the stringers. A floor board assembly is provided and is formed of two panel halves corresponding to a length of the ladder and has hinges disposed on the two panel halves. The two panel halves each have a longitudinal side fastened, in an articulated manner on the ladder rungs by the hinges. Each of the two panel halves have a slot-shaped through-passage formed therein corresponding to rung spacings and through which rung hooks of a further ladder can be guided in order to hook the rung hooks onto the rungs of the first ladder. Arresting elements are provided. Each of the arresting elements run through one of the two panel halves. The two panel halves are movable into a swung-up panel position wherein the two panel halves are arrested by the arresting elements. Each of the arresting elements have a fastening nut, a compression spring disposed between the fastening nut and an underside of a respective one of the panel-halves, and a rotatable segment plate for engaging over an outside of a respective one of the stringers. Guide profiles are disposed at the top end of the stringers, the guide profiles jut out to a side on which the floor board assembly is fitted.

It is thus possible for the ladder to be used, in a swung-up state, in the conventional manner and, in the swung-in state, as a working platform.

By virtue of the ladder according to the invention, one unit combines a telescopic lean-to ladder, which can be converted to a stepladder by laterally positioned supports which can be pivoted out, and a length-adjustable working platform in each case by two panel halves which can be swung in and swung up separately and are fastened in an articulated manner on the ladder rungs. In addition, the ladder/boarding unit can also have one side positioned horizontally in a reliable manner on steps in curved stairways, this being made possible by the ladder-stringer ends that can be length-adjusted to different extents. The other side can be adapted to the step heights by the supports, which can be adjusted in a stepless manner.

With the panel halves swung in and the supports swung in and arrested on the outsides of the ladder/boarding unit, the latter can be transported or stored particularly easily, but is also ready for use at any time as a lean-to ladder, stepladder or working platform which can be used on steps or stairways.

In accordance with an added feature of the invention, additional, telescopic ladder stringers are disposed on the stringers.

In accordance with an additional feature of the invention, the supports have bottom ends with exchangeable rubber feet that are provided with one of braking rollers and supporting-foot plates with ground spikes.

In accordance with another feature of the invention, in order to arrest the panel halves in the swung-up panel position, the arresting elements function as hooks fastened in an articulated manner on the stringers and allow the swung-up panel halves to be secured. In accordance with a further feature of the invention, U-shaped hook-in devices are fitted on an underside of the ladder in order for it to be possible for the latter to be positioned reliably on other structural parts.

In accordance with a concomitant feature of the invention, the arresting elements are arresting bolts.

Other features which are considered as characteristic for the invention are set forth in the appended claims.

Although the invention is illustrated and described herein as embodied in a ladder with a floor board, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a cross-sectional view of the ladder with the floor board with one panel half swung up and one panel half swung in;

DESCRIPTION OF THE PREFERRED EMBODIMENTS

Figure 1:
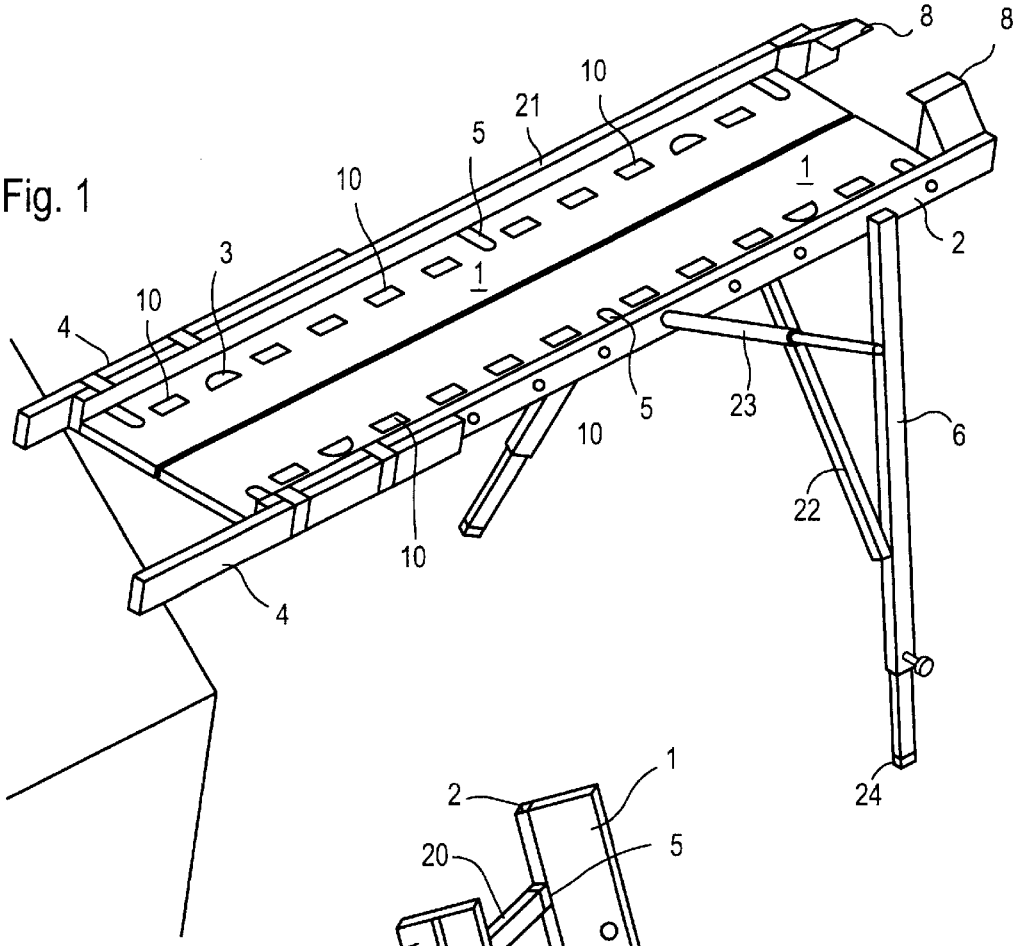
FIG. 1 is a diagrammatic, perspective view of a ladder containing a floor board, with panel halves swung in and supports pivoted out according to the invention.
Figure 2:
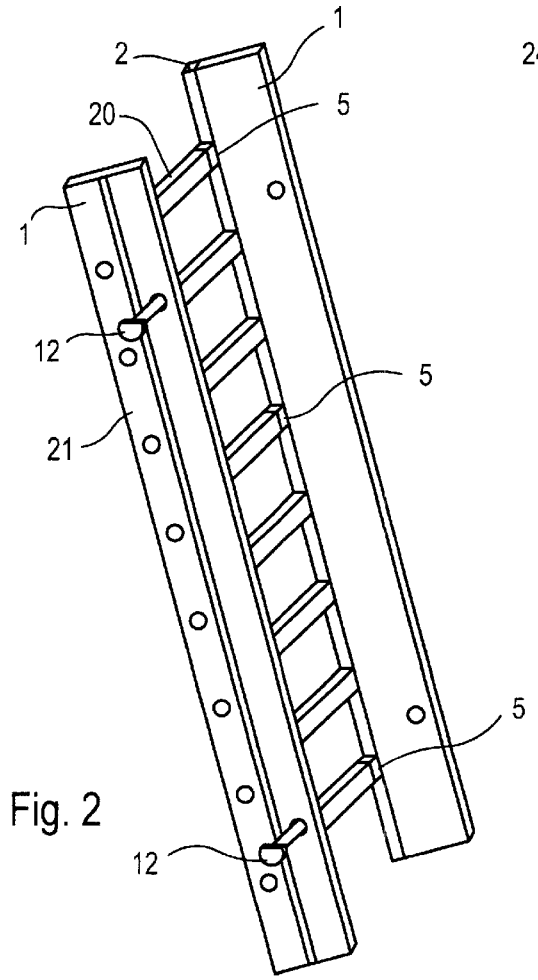
FIG. 2 is a perspective view of the ladder with the floor board with the panel halves swung up.
Figure 3:
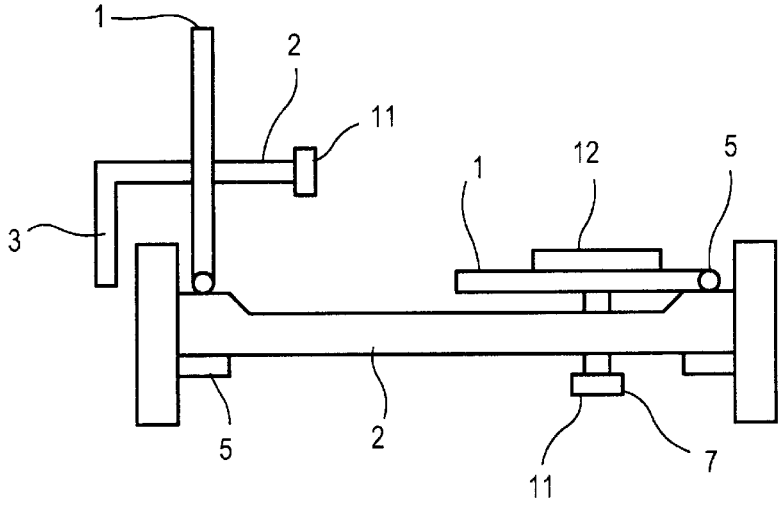

Referring now to the figures of the drawing in detail and first, particularly, to FIG. 1 thereof, there is shown two panel halves 1 positioned one beside the other and located on a top-surface side of a ladder. Hinges 5 are disposed in each case on an outer longitudinal side of a panel half, the hinges 5 being connected to ladder rungs 20 on an underside.

Figure 4:
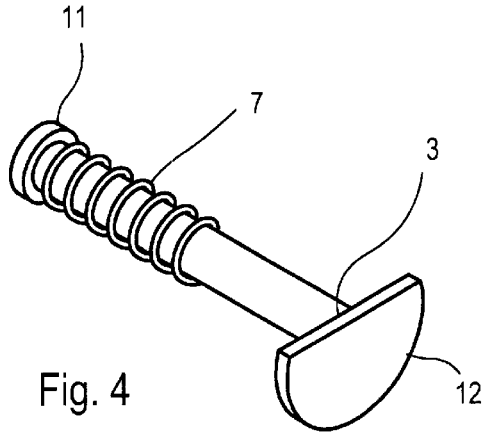
FIG. 4 is a perspective view of an arresting bolt with a segment plate and a compression spring.
Figure 5:
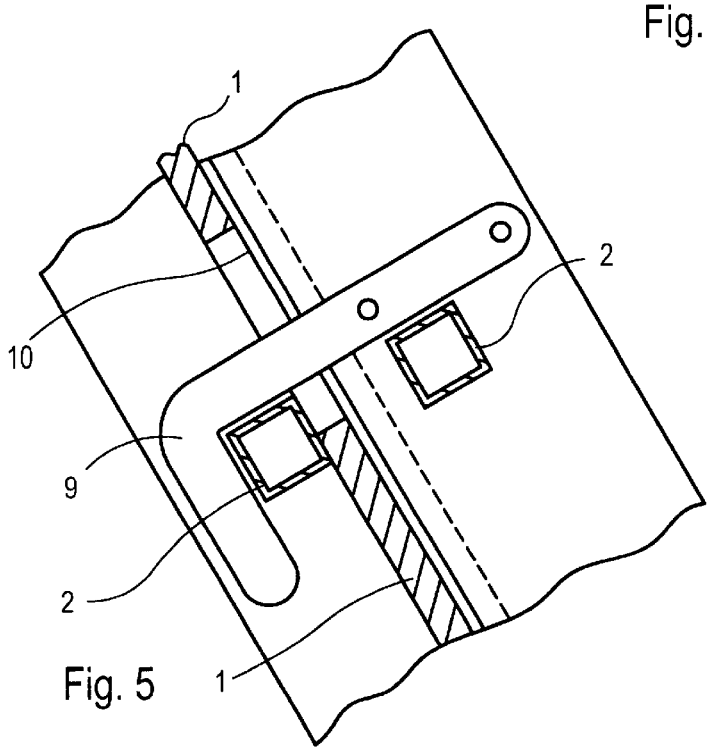
FIG. 5 is a partial, longitudinal section view of the ladder with the floor board with the panel halves swung in, a rung hook having been guided through a slot-shaped through-passage thereof and hooked into a ladder rung on the underside.

In each case two bores are preferably located in the panel halves 1, through which arresting bolts 3 with segment plates 12 are guided and secured by a nut 11 from one side (also see FIG. 4).

The bolt 3 is only of such a length as is necessary for the segment plate 12 to engage over the outside of ladder stringers or sides 21, in order to arrest the panel halves 1 in a swung-up state.

In this case, on account of the one-sided center of gravity, the segment plate 12 always also ensures that a swung-up panel half 1 is retained securely when the ladder/boarding unit is used as an erected lean-to ladder or stepladder, even if the distance between the fastening nut 11 and inside of the segment plate 12 is greater than to the outside of the ladder stringers 21.

The one-sided weight of the segment plate 12 and the associated rotation in accordance with the gravitational force requires the segment plate 12 to be of sufficient width and chord length in order for the swung-up panel halves to be arrested securely in any lean-to position of the ladder. By virtue of the segment plate 12 being rotated until the chord side of the segment plate 12 and the top side of the ladder stringers 21 are parallel, it is possible for the arresting bolt 3 with the segment plate 12 to be retracted and for the panel half 1 to be swung in.

The two stringers 21 of the ladder are each configured on both sides with telescopic, length-adjustable stringers 4, in order to reach even differing bearing widths (e.g. curved stairways) reliably, irrespective of whether the ladder is on its front side or rear side.

Disposed in an articulated manner on each outer longitudinal side (i.e. the stringer 21) of the ladder is at least one support 6 which can be pivoted out and length-adjusted in a stepless manner, secured by diagonal ties/struts 22, 23, which can likewise be adjusted in a stepless manner, and, together with the diagonal ties/struts 22, 23, can be swung in and arrested parallel to the outside of the ladder. At the bottom of the support 6 are exchangeable rubber feet 24 having braking rollers or supporting foot plates with ground spikes.

U-shaped hook-in devices are located on the underside of the ladder in order to be fitted in rungs of a second ladder. Fitted at the head of the ladder are guide profiles 8 which jut out toward the inside of the ladder to such an extent that a second ladder, even with swung-up panel halves 1, can be pushed in and out without restriction.

In order for it to be possible for rung hooks 9 disposed in the bottom region of the second ladder to hook in onto the respectively corresponding rung 20 of the first ladder, on the underside, even with the swung-in panel halves 1, the panel halves 1 of the first ladder have slot-like through-passages 10 which are provided at rung spacing and through which the rung hooks 9 of the second ladder are guided and hooked in on the rungs of the first ladder.

I claim:

1. A length-adjustable ladder functioning as a telescopic lean-to ladder, a free-standing stepladder, and as a platform, comprising:

stringers each having a top end and an outer longitudinal side;

ladder rungs fastened between said stringers;

supports connected to said stringers, said supports configured such that said supports can be length-adjusted in a stepless manner;

diagonal ties and struts adjustable in a stepless manner and connected to said supports such that said supports can be pivoted out in a plurality of directions and secured, said supports can be swung in and arrested on said outer longitudinal sides of said stringers;

a floor board assembly formed of two panel halves corresponding to a length of the ladder and having hinges disposed on said two panel halves, said two panel halves each having a longitudinal side fastened, in an articulated manner on said ladder rungs by said hinges, each of said two panel halves having slot-shaped through-passages formed therein corresponding to rung spacings and through which rung hooks of a further ladder can be guided in order to hook the rung hooks onto said rungs;

arresting elements, each of said arresting elements running through one of said two panel halves, said two panel halves movable into a swung-up panel position wherein said two panel halves being arrested by said arresting elements, each of said arresting elements having a fastening nut, a compression spring disposed between said fastening nut and an underside of a respective one of said panel-halves, and a rotatable segment plate for engaging over an outside of a respective one of said stringers; and guide profiles disposed at said top ends of said stringers, said guide profiles jutting out to a side on which said floor board assembly is fitted.

2. The ladder according to claim 1, including additional, telescopic ladder stringers disposed on said stringers.

3. The ladder according to claim 1, wherein said supports have bottom ends with exchangeable rubber feet which are provided with one of braking rollers and supporting-foot plates with ground spikes.

4. The ladder according to claim 1, wherein in order to arrest said panel halves in the swung-up panel position, said arresting elements function as hooks fastened in an articulated manner on said stringers and allow said swung-up panel halves to be secured.

5. The ladder according to claim 1, wherein said arresting elements are arresting bolts.

* * * * *